US011608610B2

(12) United States Patent
Nackers et al.

(10) Patent No.: US 11,608,610 B2
(45) Date of Patent: Mar. 21, 2023

(54) CONTROL OF A HYDRAULIC SYSTEM

(71) Applicant: Caterpillar Inc., Peoria, IL (US)

(72) Inventors: Adam Martin Nackers, Washington, IL (US); Rustin Glenn Metzger, Congerville, IL (US); Chris Rustu Cesur, Kobe (JP); Steven D Spencer, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/444,405

(22) Filed: Aug. 4, 2021

(65) Prior Publication Data

US 2023/0043231 A1 Feb. 9, 2023

(51) Int. Cl.

| | |
|---|---|
| ***E02F 3/42*** | (2006.01) |
| ***E02F 3/43*** | (2006.01) |
| ***E02F 9/22*** | (2006.01) |

(52) U.S. Cl.

CPC ..... *E02F 3/422* (2013.01); *E02F 3/434* (2013.01); *E02F 9/2221* (2013.01); *E02F 9/2292* (2013.01)

(58) Field of Classification Search

CPC ..... E02F 9/2033; E02F 3/434; E02F 3/422; E02F 9/265

See application file for complete search history.

(56) References Cited

U.S. PATENT DOCUMENTS

| | | | | |
|---|---|---|---|---|
| 6,997,221 | B2 | 2/2006 | Kurelek et al. | |
| 8,887,499 | B2 | 11/2014 | Edler et al. | |
| 9,091,286 | B2 | 7/2015 | Cesur et al. | |
| 9,297,148 | B2 | 3/2016 | Stulen et al. | |
| 9,518,371 | B2 * | 12/2016 | Wang | F15B 11/17 |
| 9,845,590 | B2 | 12/2017 | Spielman | |
| 2008/0250783 | A1 | 10/2008 | Griswold | |
| 2017/0037602 | A1 | 2/2017 | Spielman | |
| 2017/0145660 | A1 | 5/2017 | O'Neill et al. | |
| 2019/0345692 | A1 * | 11/2019 | Saitoh | F15B 20/008 |

FOREIGN PATENT DOCUMENTS

| | | |
|---|---|---|
| CN | 1993524 A | 7/2007 |
| GB | 2306705 | 5/1997 |
| GB | 2557591 | 6/2018 |

OTHER PUBLICATIONS

Written Opinion and International Search Report for Int'l. Patent Appln. No. PCT/US2022/038277, dated Nov. 21, 2022 (12 pgs).

* cited by examiner

*Primary Examiner* — Abiy Teka

(57) ABSTRACT

A hydraulic system may include a first actuator to control a first linkage member, a second actuator to control a second linkage member, a first primary hydraulic circuit and a first secondary hydraulic circuit that include the first actuator, a second primary hydraulic circuit and a second secondary hydraulic circuit that include the second actuator, a first pump to cause fluid to flow through the first primary hydraulic circuit and the second secondary hydraulic circuit, a second pump to cause fluid to flow through the second primary hydraulic circuit and the first secondary hydraulic circuit, and a controller. The controller may be configured to determine that an operator assistance mode is enabled, and cause closing of a first valve that controls fluid flow through the first secondary hydraulic circuit and a second valve that controls fluid flow through the second secondary hydraulic circuit.

18 Claims, 4 Drawing Sheets

CONTROL OF A HYDRAULIC SYSTEM

TECHNICAL FIELD

The present disclosure relates generally to a hydraulic system and, for example, to control of a hydraulic system.

BACKGROUND

A work machine or construction machine, such as an excavator or another similar type of machine, may be used to perform one or more worksite operations (e.g., material transfer, digging, grading, or the like). Typically, such a machine includes a hydraulic system to control movement of the machine and/or one or more components of the machine. For example, a hydraulic system may be used to control a work implement of a machine. More specifically, a hydraulic system of an excavator may be used to control movement of the excavator, rotation of a body of the excavator (e.g., for a swing operation), and/or movement of a component of the excavator that includes a boom, a stick, and a bucket.

A hydraulic system may include a pump that supplies pressurized fluid to one or more hydraulic circuits to thereby cause actuation of one or more actuators (e.g., cylinders). In some examples, a hydraulic system may utilize two or more pumps that cause fluid flow through respective hydraulic circuits to cause actuation of one or more actuators. For example, a hydraulic system for an excavator may include a primary boom hydraulic circuit and a secondary boom hydraulic circuit in fluid communication with one or more boom actuators, and a primary stick hydraulic circuit and a secondary stick hydraulic circuit in fluid communication with one or more stick actuators. A first pump may cause fluid flow through the primary boom hydraulic circuit and the secondary stick hydraulic circuit, and a second pump may cause fluid flow through the primary stick hydraulic circuit and the secondary boom hydraulic circuit. During operations of the excavator that utilize both the boom and the stick, pressure and restriction differences in the hydraulic circuits may cause interference that results in excess or reduced flow at the boom actuator(s) and/or the stick actuator(s). Deviation from a desired fluid flow may cause imbalance of the velocities of the hydraulic circuits, resulting in reduced motion accuracy.

Some operations performed by a machine may require a high degree of precision. For example, an excavator may perform grading operations using an operator assistance mode. In the operator assistance mode, movement of the boom, the stick, and/or the bucket may be automated to maintain a trajectory of the bucket at a grade line. Thus, the reduced motion accuracy resulting from deviation from the desired fluid flow may prevent achievement of the degree of precision necessary to maintain the trajectory of the bucket at the grade line.

U.S. Pat. No. 9,845,590 (the '590 patent) discloses a hydraulic system for providing hydraulic power to the work implements and subassemblies on an earth-moving machine that includes a first hydraulic pump and a second hydraulic pump. The '590 patent indicates that the first hydraulic pump can be associated with a lift circuit including a lift arm that can be raised and lowered with respect to the machine, and the second hydraulic pump can be associated with both a tilt circuit for tilting a bucket pivotally connected to the lift arm and a steering circuit for steering the machine. The '590 patent states that the lift circuit and the tilt and steering circuits can be operated concurrently and independently of each other due to the arrangement of the first hydraulic pump and the second hydraulic pump.

The controller for a hydraulic system of the present disclosure provides for independent control of a first actuator using a first pump and independent control of a second actuator using a second pump during an operation requiring a high degree of precision, such as a grading operation using an operator assistance mode. Otherwise, the first actuator may be controlled using the first pump and the second pump in concert, and the second actuator may be controlled using the first pump and the second pump in concert. Thus, the controller for the hydraulic system of the present disclosure solves one or more of the problems set forth above and/or other problems in the art.

SUMMARY

A hydraulic system may include a first actuator to control a first linkage member; a second actuator to control a second linkage member connected to the first linkage member and to a work implement of a machine; a first primary hydraulic circuit and a first secondary hydraulic circuit that include the first actuator; a second primary hydraulic circuit and a second secondary hydraulic circuit that include the second actuator; a first pump to cause fluid to flow through the first primary hydraulic circuit and the second secondary hydraulic circuit; a second pump to cause fluid to flow through the second primary hydraulic circuit and the first secondary hydraulic circuit; and a controller. The controller may be configured to: determine that an operator assistance mode is enabled for the machine; and cause, based on determining that the operator assistance mode is enabled, closing of a first valve that controls fluid flow through the first secondary hydraulic circuit and a second valve that controls fluid flow through the second secondary hydraulic circuit.

A method may include determining that an operator assistance mode is enabled for a machine having a work implement, where a first linkage member of the machine is controlled by a first actuator, and a second linkage member of the machine, connected to the first linkage member and to the work implement, is controlled by a second actuator, and where a first primary hydraulic circuit and a first secondary hydraulic circuit include the first actuator, and a second primary hydraulic circuit and a second secondary hydraulic circuit include the second actuator. The method may include detecting that a position of the work implement satisfies a condition relating to the operator assistance mode. The method may include causing, based on determining that the operator assistance mode is enabled and detecting that the position of the work implement satisfies the condition, closing of a first valve that controls fluid flow through the first secondary hydraulic circuit and a second valve that controls fluid flow through the second secondary hydraulic circuit.

An excavator may include a bucket; a stick member connected to the bucket; a boom member connected to the stick member; a stick actuator to control the stick member; a boom actuator to control the boom member; a primary stick hydraulic circuit and a secondary stick hydraulic circuit that include the stick actuator; a primary boom hydraulic circuit and a secondary boom hydraulic circuit that include the boom actuator; a first pump to cause fluid to flow through the primary boom hydraulic circuit and the secondary stick hydraulic circuit; a second pump to cause fluid to flow through the primary stick hydraulic circuit and the secondary boom hydraulic circuit; and a controller. The controller may be configured to detect that a position of the bucket satisfies a condition; and cause, based on detecting that the position of the bucket satisfies the condition, closing of a first valve that controls fluid flow through the secondary boom hydraulic circuit and a second valve that controls fluid flow through the secondary stick hydraulic circuit.

DETAILED DESCRIPTION

This disclosure relates to a controller for a hydraulic system, and is applicable to any machine that utilizes a hydraulic system to control movement of the machine and/or one or more components of the machine. For example, the machine may be an excavator, a vehicle, a compactor machine, a paving machine, a cold planer, a grading machine, a backhoe loader, a wheel loader, a harvester, a motor grader, a skid steer loader, a tractor, a dozer, or the like.

Figure 1:
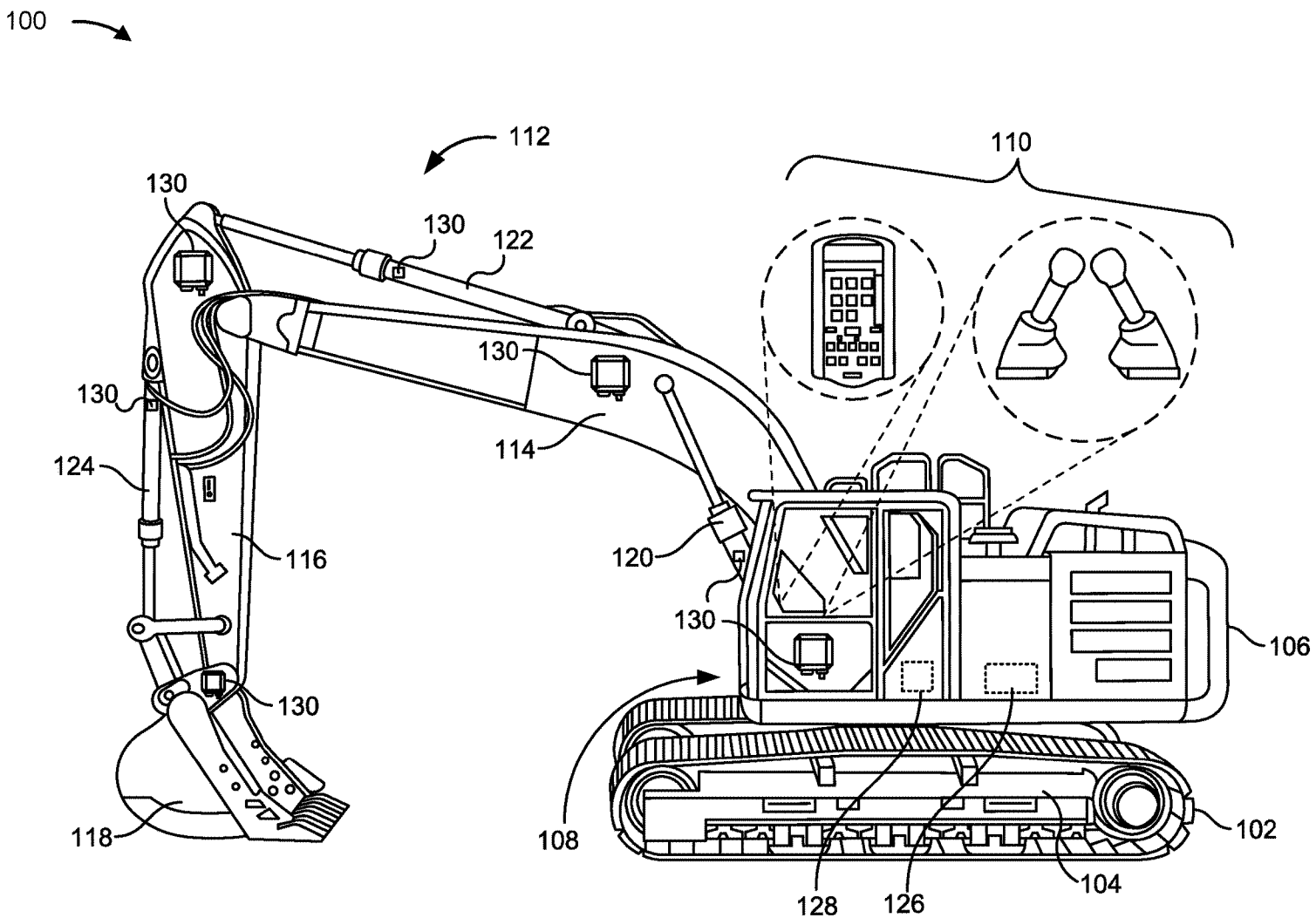
FIG. 1 is a diagram of an example machine described herein.

FIG. 1 is a diagram of an example machine 100 described herein. As shown in FIG. 1, machine 100 is embodied as an earth moving machine, such as an excavator. Alternatively, machine 100 may be another earth moving machine, another work machine, or the like.

As shown in FIG. 1, machine 100 includes ground engaging members 102, such as tracks, wheels, rollers, or the like, for propelling machine 100. Ground engaging members 102 are mounted on a car body 104 and are driven by one or more engines, one or more electric motors, one or more batteries, and/or one or more drive trains. The car body 104 supports a rotatable machine body 106 and an operator station 108. The operator station 108 is supported by and/or is included within the machine body 106, which may be supported by a rotatable frame situated between the machine body 106 and the car body 104. The operator station 108 includes one or more operator interfaces 110 (shown as an integrated display and operator control devices, such as joysticks).

As shown in FIG. 1, machine 100 includes a linkage assembly 112 that includes a boom member 114, a stick member 116, and a bucket 118. The linkage assembly 112 may include other types of work tools, such as a hammer drill, ripper, or the like. As described herein, movement of the machine body 106 and/or movement of the linkage assembly 112 (e.g., relative to the machine body 106) may be controlled and/or performed via a hydraulic system. As described herein, the hydraulic system may include a plurality of hydraulic circuits to control one or more functions of machine 100, the machine body 106, and/or the linkage assembly 112. Such functions and/or operations may include a boom-up or boom-down operation associated with the boom member 114, a stick-in or stick-out operation associated with the stick member 116, a bucket-in or bucket-out operation associated with the bucket 118, a swing function associated with the machine body 106, or the like. Such functions may be performed in association with one or more operations of the machine (e.g., a grading operation, a dig operation, a material transfer operation, a travel operation, or the like).

As shown in FIG. 1, the boom member 114 is pivotably mounted to the machine body 106 at a proximal end of the boom member 114. The boom member 114 can be articulated relative to the machine body 106 by a boom actuator 120 (e.g., a fluid actuation cylinder, such as a hydraulic cylinder, a pneumatic cylinder, or the like) of the hydraulic system. A proximal end of the stick member 116 is pivotably mounted to the boom member 114 at a distal end of the boom member 114. The stick member 116 can be articulated relative to boom member 114 by a stick actuator 122 of the hydraulic system. A proximal end of the bucket 118 is pivotably mounted to the stick member 116 at a distal end of the stick member 116. The bucket 118 can be articulated relative to the stick member 116 by a bucket actuator 124 of the hydraulic system.

The hydraulic system of machine 100 may include one or more (e.g., multiple) hydraulic pumps 126 that provide a flow source (e.g., a fixed flow rate or a variable flow rate) of fluid (e.g., oil or another type of hydraulic fluid) to a plurality of hydraulic circuits (e.g., individual hydraulic circuits associated with the boom actuator 120, the stick actuator 122, the bucket actuator 124, one or more swing actuators (not shown) to swing the machine body 106, a travel system (not shown) of machine 100, or the like) of the hydraulic system. A hydraulic pump 126 provides fluid, from a main line fluidly coupled to a discharge end of the hydraulic pump 126 to one or more hydraulic circuits. As described herein, flow through the one or more hydraulic circuits may be controlled via electromechanical control of individual circuit valves of the one or more hydraulic circuits.

As shown in FIG. 1, machine 100 may include a controller 128 (e.g., an electronic control module (ECM)) and a plurality of sensors 130 (referred to herein individually as a "sensor 130," and referred to collectively as "sensors 130"). The controller 128 may control and/or monitor operations of machine 100. For example, the controller 128 may control and/or monitor the operations of machine 100 based on signals from the sensors 130 and/or operator inputs received from operator interfaces 110. The controller 128 may include one or more memories and one or more processors that implement operations associated with control of the hydraulic system, as described herein.

As shown in FIG. 1, the sensors 130 are located at different positions on and/or within various components or portions of machine 100. For example, sensors 130 may include one or more motion sensors (e.g., cameras, accelerometers, gyroscopes, inertial measurement sensors, speed sensors, position sensors, or the like) that may be positioned on the machine body 106, the boom member 114, the stick member 116, and/or the bucket 118. In such an example, the controller 128, from information received from the sensors 130, may detect and/or determine movement of machine 100, movement of the machine body 106, movement of the linkage assembly 112, a position of machine 100 (e.g., relative to an environment of machine 100), an orientation of machine 100, or the like. For example, the controller 128, from information received from the sensors 130, may detect and/or determine a position of the bucket 118 (e.g., teeth of the bucket 118) relative to a ground surface, a grade line, or the like.

Additionally, or alternatively, sensors 130 may include one or more pressure sensors included within the actuators (e.g., at a head end, at a rod end, within a fluid line to or from the actuators, or the like) of machine 100. In such an example, the controller 128 may determine one or more pressures associated with the boom actuator 120, the stick actuator 122, the bucket actuator 124, a swing actuator (not shown), a travel system (not shown), or the like.

As indicated above, FIG. 1 is provided as an example. Other examples may differ from what is described in connection with FIG. 1.

Figure 2:
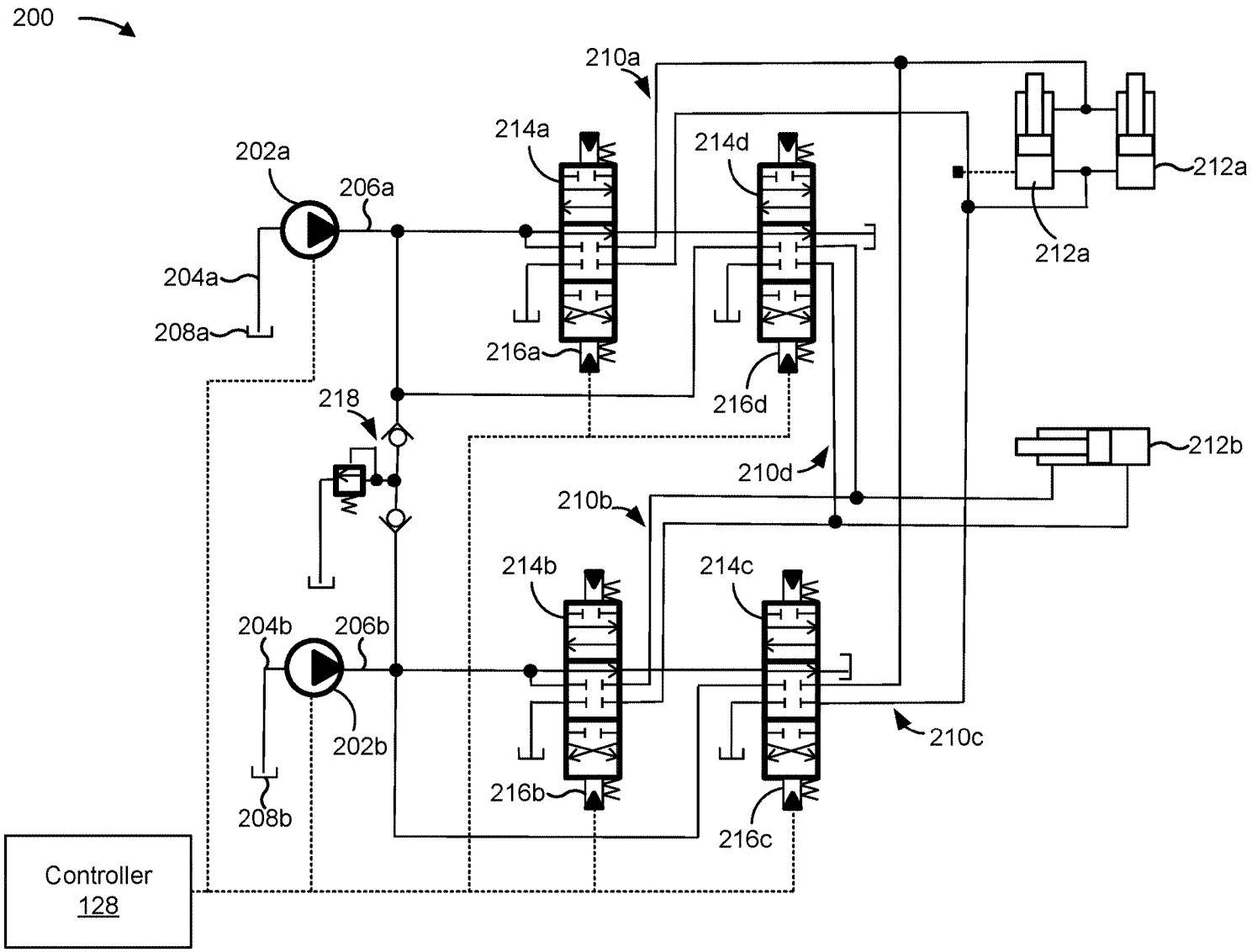
FIG. 2 is a diagram of an example hydraulic system described herein.

FIG. 2 is a diagram of an example hydraulic system 200, described herein. Hydraulic system 200 includes multiple hydraulic pumps, shown as a first hydraulic pump 202*a* and a second hydraulic pump 202*b* (which may correspond to hydraulic pump 126). In some examples, hydraulic system 200 may include more than two hydraulic pumps, such as three hydraulic pumps or four hydraulic pumps. Hydraulic system 200 may include feed lines 204*a* and 204*b*, main lines 206*a* and 206*b*, and fluid reservoirs 208*a* and 208*b*. The feed line 204*a* is fluidly coupled to the fluid reservoir 208*a* and to an intake end of the first hydraulic pump 202*a*. The feed line 204*b* is fluidly coupled to the fluid reservoir 208*b* and to an intake end of the second hydraulic pump 202*b*. In some examples, the feed line 204*a* and the feed line 204*b* may share the same fluid reservoir.

The main line 206*a* is fluidly coupled to a discharge of the first hydraulic pump 202*a*, to circuit lines (and/or circuit valves) of hydraulic circuits 210*a* and 210*d*, and to the fluid reservoir 208*a*. The main line 206*b* is fluidly coupled to a discharge of the second hydraulic pump 202*b*, to circuit lines (and/or circuit valves) of hydraulic circuits 210*b* and 210*c*, and to the fluid reservoir 208*b*. The first hydraulic pump 202*a* may be any suitable fluid pumping mechanism that is configured to draw, via the feed line 204*a*, fluid from the fluid reservoir 208*a* to cause the fluid to flow through main line 206*a* to hydraulic circuits 210*a* and 210*d* and back to the fluid reservoir 208*a*. Similarly, the second hydraulic pump 202*b* may be any suitable fluid pumping mechanism that is configured to draw, via the feed line 204*b*, fluid from the fluid reservoir 208*b* to cause the fluid to flow through main line 206*b* to hydraulic circuits 210*b* and 210*c* and back to the fluid reservoir 208*b*.

Hydraulic system 200 includes a first actuator 212*a* (shown as two cylinders) and a second actuator 212*b* (shown as a single cylinder). As used herein, an "actuator" may refer to a single actuator or a set of actuators. The first actuator 212*a* may control a first linkage member of a linkage assembly of a machine. For example, the first actuator 212*a* may correspond to boom actuator 120 that controls the boom member 114 of the linkage assembly 112 of machine 100. The second actuator 212*b* may control a second linkage member connected to the first linkage member and to a work implement of the machine. For example, the second actuator 212*b* may correspond to stick actuator 122 that controls the stick member 116 of the linkage assembly 112 of machine 100. In some examples, hydraulic system 200 may include one or more additional actuators, such as an actuator to control a work implement (e.g., bucket 118), an actuator to control a swing of a machine, or the like.

The hydraulic circuit 210*a* may include the fluid reservoir 208*a*, the first hydraulic pump 202*a*, a valve 214*a*, and the first actuator 212*a*. The hydraulic circuit 210*a* may be a primary hydraulic circuit (i.e., a first primary hydraulic circuit) of the first actuator 212*a*. For example, the hydraulic circuit 210*a* may be a primary boom hydraulic circuit of the boom actuator 120. The hydraulic circuit 210*c* may include the fluid reservoir 208*b*, the second hydraulic pump 202*b*, a valve 214*c*, and the first actuator 212*a*. The hydraulic circuit 210*c* may be a secondary hydraulic circuit (i.e., a first secondary hydraulic circuit) of the first actuator 212*a*. For example, the hydraulic circuit 210*c* may be a secondary boom hydraulic circuit of the boom actuator 120.

The hydraulic circuit 210*a* and the hydraulic circuit 210*c* may, in concert, provide control of the first actuator 212*a* (e.g., via valves 214*a* and 214*c*), which may be associated with a function of a machine. For example, the hydraulic circuit 210*a* and the hydraulic circuit 210*c* may, in concert, provide control of the boom actuator 120. Thus, the first hydraulic pump 202*a* and the second hydraulic pump 202*b* may together control the first actuator 212*a* via the hydraulic circuit 210*a* and the hydraulic circuit 210*c*, respectively.

The hydraulic circuit 210*b* may include the fluid reservoir 208*b*, the second hydraulic pump 202*b*, a valve 214*b*, and the second actuator 212*b*. The hydraulic circuit 210*b* may be a primary hydraulic circuit (i.e., a second primary hydraulic circuit) of the second actuator 212*b*. For example, the hydraulic circuit 210*b* may be a primary stick hydraulic circuit of the stick actuator 122. The hydraulic circuit 210*d* may include the fluid reservoir 208*a*, the first hydraulic pump 202*a*, a valve 214*d*, and the second actuator 212*b*. The hydraulic circuit 210*d* may be a secondary hydraulic circuit (i.e., a second secondary hydraulic circuit) of the second actuator 212*b*. For example, the hydraulic circuit 210*d* may be a secondary stick hydraulic circuit of the stick actuator 122.

The hydraulic circuit 210*b* and the hydraulic circuit 210*d* may, in concert, provide control of the second actuator 212*b* (e.g., via valves 214*b* and 214*d*), which may be associated with a function of a machine. For example, the hydraulic circuit 210*b* and the hydraulic circuit 210*d* may, in concert, provide control of the stick actuator 122. Thus, the first hydraulic pump 202*a* and the second hydraulic pump 202*b* may together control the second actuator 212*b* via the hydraulic circuit 210*b* and the hydraulic circuit 210*d*, respectively.

In some examples, hydraulic system 200 may include one or more additional hydraulic circuits controlled by the first hydraulic pump 202*a* and/or one or more additional hydraulic circuits controlled by the second hydraulic pump 202*b*. For example, hydraulic system 200 may include a hydraulic circuit for control of a work implement (e.g., bucket 118), a hydraulic circuit for control of a swing of a machine, one or more hydraulic circuits for control of a travel system, or the like.

The valves 214*a*, 214*b*, 214*c*, and 214*d* each may be any suitably configured valve that is capable of being controlled by a respective valve control device 216*a*, 216*b*, 216*c*, and 216*d* (e.g., based on receiving instructions from controller 128). For example, the valves 214*a* to 214*d* may be spool valves. As an example, the valves 214*a* to 214*d* may be individually configured spool valves with electromechanical configurations that are configured specifically for functional control of the actuators 212*a* and 212*b* (e.g., according to responsiveness, performance, sizes, ranges of operation, cylinder type, or the like).

The first hydraulic pump 202*a*, during operation, and according to configurations of the valves 214*a* and 214*d* (e.g., based on settings for positions of the valves), causes fluid to flow to, through, and/or from the hydraulic circuits 210*a* and 210*d*. In the example of FIG. 2, any adjustment to an opening of one of the valves 214*a* or 214*d* would likely affect, due to physical properties of hydraulic system 200, flow through a hydraulic circuit 210*a* or 210*d* that is not associated with the adjusted valve 214*a* or 214*d*. The second hydraulic pump 202*b*, during operation, and according to configurations of the valves 214*b* and 214*c* (e.g., based on settings for positions of the valves), causes fluid to flow to, through, and/or from the hydraulic circuits 210*b* and 210*c*. In the example of FIG. 2, any adjustment to an opening of one of the valves 214*b* or 214*c* would likely affect, due to physical properties of hydraulic system 200, flow through a hydraulic circuit 210*b* or 210*c* that is not associated with the adjusted valve 214*b* or 214*c*.

As described herein, the controller 128 is configured to cause the valve control devices 216*a* to 216*d* to configure or position one or more components (e.g., spools, stems, actuators, plugs, apertures, or the like) of the valves 214*a* to 214*d*, respectively, to increase and/or decrease an opening of the valves 214*a* to 214*d* (e.g., by increasing or decreasing an area of a passageway that flows through one or more of the respective valves 214*a* to 214*d*). More specifically, the controller 128 may instruct the valve control devices 216*a* to 216*d* to set positions of spools of the valves 214*a* to 214*d*, respectively, to control the sizes of openings and, correspondingly, the flow of the fluid throughout the hydraulic circuits 210*a* to 210*d* (e.g., according to a hydraulic flow command, or the like). As shown, the controller 128 is also configured to cause the first hydraulic pump 202*a* and the second hydraulic pump 202*b* to increase and/or decrease a rate of flow of fluid (e.g., increase and/or decrease a pressurization of fluid) to the hydraulic circuits 210*a* to 210*d*.

As shown in FIG. 2, hydraulic system 200 may include a pressure relief component 218. The pressure relief component 218 may relieve pressure in hydraulic system 200 if a pressure exceeds a threshold.

As indicated above, FIG. 2 is provided as an example. Other examples may differ from what was described in connection with FIG. 2.

Figure 3:
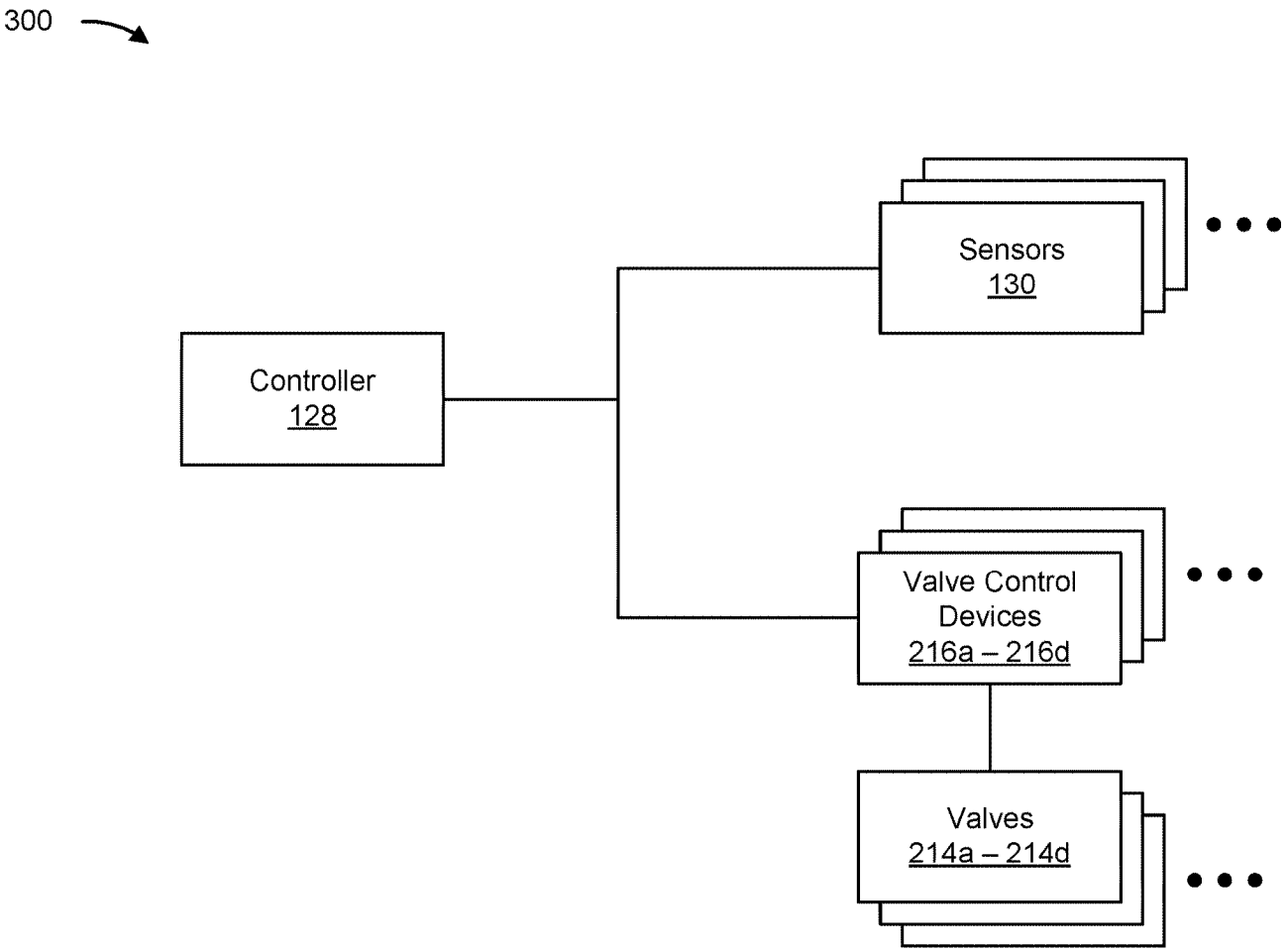
FIG. 3 is a diagram of an example system in which example devices and/or example methods, described herein, may be implemented.

FIG. 3 is a diagram of an example system 300 in which example devices and/or example methods, described herein, may be implemented. System 300 may provide control of hydraulic system 200. System 300 includes the controller 128. The controller 128 is communicatively connected to the sensors 130 and to the valve control devices 216*a* to 216*d*, described above. As shown, the valve control devices 216*a* to 216*d* provide control of valves 214*a* to 214*d*, respectively, and the valves 214*a* to 214*d* control the flow of fluid through hydraulic circuits 210*a* to 210*d*, respectively, as described above.

The controller 128 may be configured to determine whether an operator assistance mode is enabled for machine 100. In the operator assistance mode, the controller 128 may automate one or more movements of machine 100, or a work implement of machine 100, to achieve a higher degree of precision of the movements than would be possible by manual operator control. For example, the operator assistance mode may relate to digging operations, cutting operations, milling operations, leveling operations, or the like, of machine 100.

In one example, the operator assistance mode may be for grading operations performed by machine 100. For example, in the operator assistance mode, the controller 128 may receive (e.g., via operator interfaces 110) an input of an operator setting of a grade line (e.g., a grade depth, or the like) that is to be targeted during a grading operation of machine 100. As another example, in the operator assistance mode, the controller 128 may receive (e.g., from a remote device) an operating plan (e.g., a set of instructions) that indicates a grade line that is to be targeted during a grading operation of machine 100. When the operator assistance mode is enabled, the controller 128 may activate the operator assistance mode based on detecting (e.g., using the sensors 130) that a position of a work implement (e.g., bucket 118) is a threshold distance from the grade line. When the operator assistance mode is activated, the controller 128 may automate movement of one or more members of a linkage assembly (e.g., linkage assembly 112), a work implement (e.g., bucket 118), or the like, of machine 100. For example, when the operator assistance mode is activated, the controller 128 may automate movement of the boom member 114, the stick member 116, and/or the bucket 118 to maintain a position of the bucket 118 (e.g., teeth of the bucket 118) at the grade line.

The controller 128 may be configured to detect whether a position of a work implement (e.g., bucket 118) of machine 100 satisfies a condition. The controller 128 may detect the position of the work implement using the sensors 130. For example, the controller 128 may detect the position of the bucket 118 using one or more sensors 130 associated with the bucket 118, one or more sensors 130 associated with the stick member 116, one or more sensors 130 associated with the boom member 114, and/or one or more sensors 130 associated with the car body 104 and/or the machine body 106 (e.g., a chassis) of machine 100 (e.g., for pitch and/or roll sensing).

The condition may be that the position of the work implement is a threshold distance from a ground surface, from machine 100, or the like. In one example, the condition may be that the position of the work implement is a threshold distance from the grade line (e.g., and that the work implement is moving toward the grade line). Here, the threshold distance from the grade line may be based on a different threshold distance from the grade line used for activating the operator assistance mode (e.g., the condition relates to the operator assistance mode). For example, the threshold distance from the grade line may be further from the grade line than the different threshold distance from the grade line used for activating the operator assistance mode. That is, as the work implement is moving toward the grade line, the controller 128 may detect that the position of the work implement satisfies the condition prior to activating the operator assistance mode.

The controller 128 may be configured to cause closing (e.g., an adjustment to a position) of the valve 214*c* (e.g., that controls fluid flow through the hydraulic circuit 210*c*; that is, the first secondary hydraulic circuit) and the valve 214*d* (e.g., that controls fluid flow through the hydraulic circuit 210*d*; that is, the second secondary hydraulic circuit). For example, the controller 128 may cause closing of the valves 214*c* and 214*d* based on determining that the operator assistance mode is enabled and/or based on detecting that the position of the work implement satisfies the condition (e.g., based on detecting that the position of the work implement is the threshold distance from the grade line).

To cause closing of the valves 214*c* and 214*d*, the controller 128 may determine a first fluid flow setting (e.g., a fluid flow limit) for the valve 214*c* and a second fluid flow setting for the valve 214*d*. The first fluid flow setting and the second fluid flow setting may be the same value or different values. In some implementations, the first fluid flow setting and the second fluid flow setting may be a zero value (e.g., indicating that the valve 214*c* and the valve 214*d* are to be fully closed). Alternatively, the first fluid flow setting and the second fluid flow setting may be greater than a zero value (e.g., indicating that the valve 214*c* and the valve 214*d* are to be partially closed, such as 90% closed, 80% closed, 70% closed, or the like).

Thus, the controller 128 may cause closing of the valve 214*c* for the hydraulic circuit 210*c* according to the first fluid flow setting and cause closing of the valve 214*d* for the hydraulic circuit 210*d* according to the second fluid flow setting. For example, the controller 128 may provide a command associated with the first fluid flow setting to the valve control device 216*c* to cause the valve control device 216*c* to adjust a position of the valve 214*c* according to the first fluid flow setting, and provide a command associated with the second fluid flow setting to the valve control device 216*d* to cause the valve control device 216*d* to adjust a position of the valve 214*d* according to the second fluid flow setting.

The controller 128 may cause closing of the valves 214*c* and 214*d* to cause a re-allocation of fluid flow through the hydraulic circuits 210*a* to 210*d*. In some implementations, the controller 128 may cause partial closing of the valves 214*c* and 214*d*. Alternatively, the controller 128 may cause full closing of the valves 214*c* and 214*d*. For example, upon detecting that the position of the work implement satisfies the condition, the controller 128 may begin causing closing of the valves 214*c* and 214*d* so that the valves 214*c* and 214*d* are fully closed by a time that (e.g., before) the operator assistance mode is activated. Stated differently, the controller 128 may cause closing of the valves 214*c* and 214*d* based on determining that the operator assistance mode is to be activated. In some implementations, an amount of partial closing of the valve 214*c* may be different from an amount of partial closing of the valve 214*d*. In some implementations, one of the valves 214*c* and 214*d* may be fully closed and the other of the valves 214*c* and 214*d* may be partially closed.

Closing of the valves 214*c* and 214*d* may deactivate, or limit the activation of, the hydraulic circuit 210*c* and the hydraulic circuit 210*d*, respectively. For example, the controller 128 may cause closing of the valves 214*c* and 214*d* until fluid flow through the hydraulic circuit 210*c* and the hydraulic circuit 210*d* is absent (e.g., the hydraulic circuit 210*c* and the hydraulic circuit 210*d* are deactivated). In this way, the controller 128 may cause closing of the valves 214*c* and 214*d* to isolate the first actuator 212*a* from the second hydraulic pump 202*b* and isolate the second actuator 212*b* from the first hydraulic pump 202*a*. For example, after the valves 214*c* and 214*d* are closed (e.g., fully closed), control of the first actuator 212*a* (e.g., the boom actuator 120) may be provided only by the first hydraulic pump 202*a*, and control of the second actuator 212*b* (e.g., the stick actuator 122) may be provided only by the second hydraulic pump 202*b*, thereby improving the precision of actuation of the first actuator 212*a* and the second actuator 212*b*, such as by minimizing or eliminating cross-talk between the operating hydraulic circuits.

The controller 128 may be configured to cause opening (e.g., relative to a current closed state) of the valves 214*c* and 214*d*. For example, the controller 128 may cause opening of the valves 214*c* and 214*d* based on determining that the operator assistance mode is deactivated, based on determining that the operator assistance mode is disabled, and/or based on detecting that the position of the work implement (e.g., bucket 118) satisfies a different condition. For example, the different condition may be that the position of the work implement is a threshold distance from a ground surface, from machine 100, or the like. In one example, the different condition may be that the position of the work implement is a threshold distance from the grade line. Here, the threshold distance from the grade line used for opening of the valves 214*c* and 214*d* may be different than the threshold distance from the grade line used for closing of the valves 214*c* and 214*d*, as described above. For example, the threshold distance from the grade line for opening of the valves 214*c* and 214*d* may be further from the grade line than the threshold distance from the grade line for closing of the valves 214*c* and 214*d*.

To cause opening of the valves 214*c* and 214*d*, the controller 128 may determine a new fluid flow setting for the valve 214*c* and a new fluid flow setting for the valve 214*d*, in a similar manner as described above. The new fluid flow settings for the valves 214*c* and 214*d* may be greater values than the first and second fluid flow settings used for closing the valves 214*c* and 214*d* (e.g., to thereby activate, or increase the activation of, the hydraulic circuit 210*c* and the hydraulic circuit 210*d*). As an example, the new fluid flow settings for the valves 214*c* and 214*d* may be a value(s) that was used prior to closing of the valves 214*c* and 214*d*, as described above. The controller 128 may provide a command associated with the new fluid flow setting for the valve 214*c* to the valve control device 216*c* to cause the valve control device 216*c* to adjust a position of the valve 214*c* according to the new fluid flow setting, and provide a command associated with the new fluid flow setting for the valve 214*d* to the valve control device 216*d* to cause the valve control device 216*d* to adjust a position of the valve 214*d* according to the new fluid flow setting.

As indicated above, FIG. 3 is provided as an example. Other examples may differ from what was described in connection with FIG. 3.

Figure 4:
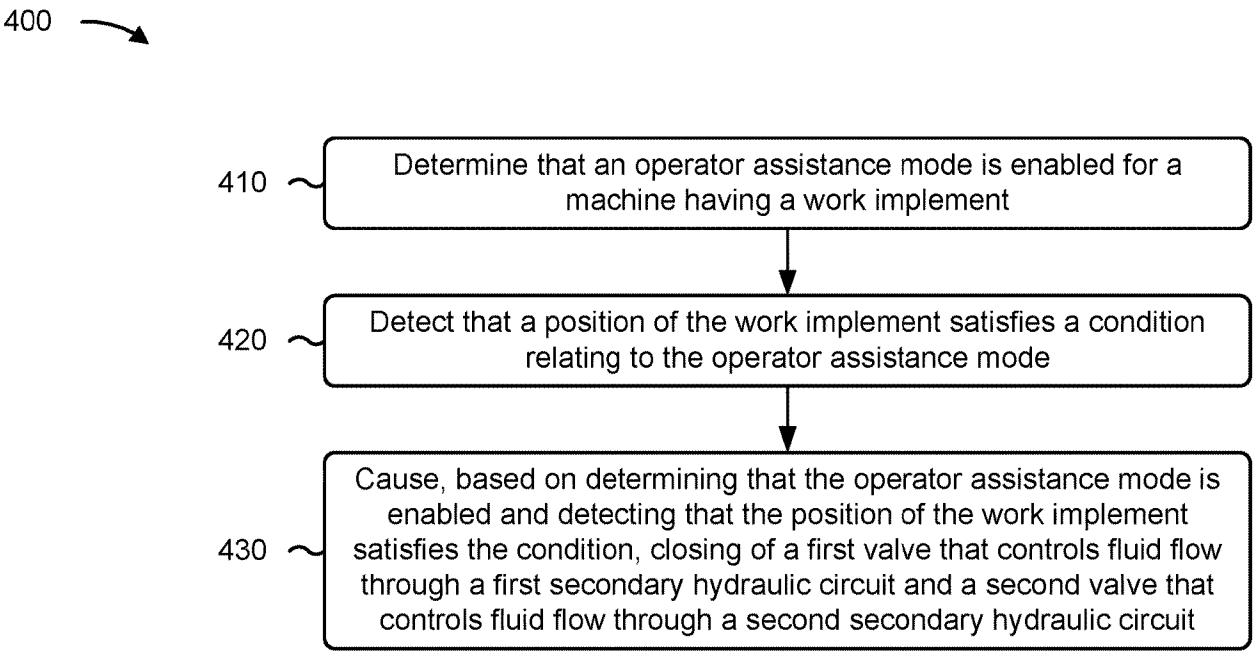
FIG. 4 is a flowchart of an example process relating to control of a hydraulic system.

FIG. 4 is a flowchart of an example process 400 associated with control of a hydraulic system. One or more process blocks of FIG. 4 may be performed by a controller (e.g., controller 128). Additionally, or alternatively, one or more process blocks of FIG. 4 may be performed by another device or a group of devices separate from or including the controller, such as another device or component that is internal or external to machine 100.

As shown in FIG. 4, process 400 may include determining that an operator assistance mode is enabled for a machine having a work implement (block 410). For example, the controller (e.g., using a processor, a memory, a storage component, or the like) may determine that an operator assistance mode is enabled for a machine having a work implement. The machine may include a first linkage member controlled by a first actuator, and a second linkage member, connected to the first linkage member and to the work implement, controlled by a second actuator, as described above. The work implement may be a bucket, the first linkage member may be a boom member, and the second linkage member may be a stick member. The machine may include a first primary hydraulic circuit and a first secondary hydraulic circuit that include the first actuator, and a second primary hydraulic circuit and a second secondary hydraulic circuit that include the second actuator, as described above. The machine may include a first pump configured to cause fluid to flow through the first primary hydraulic circuit and the second secondary hydraulic circuit, and a second pump configured to cause fluid to flow through the second primary hydraulic circuit and the first secondary hydraulic circuit.

The operator assistance mode may be for a grading operation a leveling operation, or a digging operation. The operator assistance mode may automate movement of one or more of the first linkage member, the second linkage member, or the work implement.

As further shown in FIG. 4, process 400 may include detecting that a position of the work implement satisfies a condition relating to the operator assistance mode (block 420). For example, the controller (e.g., using a processor, a memory, an input component, or the like) may detect that a position of the work implement satisfies a condition relating to the operator assistance mode, as described above. The position of the work implement may be detected using one or more sensors associated with one or more of the bucket, the stick member, or the boom member.

The condition may be that the position of the work implement is a threshold distance from a grade line. The grade line may be according to an operator setting for the machine or an operating plan for the machine. The threshold distance from the grade line may be further from the grade line than a different threshold distance from the grade line used for activating the operator assistance mode.

As further shown in FIG. 4, process 400 may include causing, based on determining that the operator assistance mode is enabled and detecting that the position of the work implement satisfies the condition, closing of a first valve that controls fluid flow through the first secondary hydraulic circuit and a second valve that controls fluid flow through the second secondary hydraulic circuit (block 430). For example, the controller (e.g., using a processor, a memory, a communication interface, or the like) may cause closing of a first valve that controls fluid flow through the first secondary hydraulic circuit and a second valve that controls fluid flow through the second secondary hydraulic circuit, as described above. The controller may cause full closing or partial closing of the first valve and the second valve. Causing closing of the first valve and the second valve may isolate the first actuator from the second pump and isolate the second actuator from the first pump.

Causing closing of the first valve and the second valve may include determining a first fluid flow setting for the first valve and a second fluid flow setting for the second valve, and causing closing of the first valve according to the first fluid flow setting and closing of the second valve according to the second fluid flow setting. Process 400 may include detecting that the position of the work implement satisfies a different condition, and causing, based on detecting that the position of the work implement satisfies the different condition, opening of the first valve and the second valve.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

The controller for a hydraulic system described herein can be used with any machine that utilizes a hydraulic system. For example, the controller can be used with a machine that utilizes a hydraulic system to control the machine and/or a component of the machine. In particular, the controller is useful for controlling a hydraulic system that utilizes multiple pumps to provide control of multiple actuators. For example, in the hydraulic system, control of a first actuator may be provided via a first primary hydraulic circuit controlled by a first pump and via a first secondary hydraulic circuit controlled by a second pump. Continuing with the example, in the hydraulic system, control of a second actuator may be provided via a second primary hydraulic circuit controlled by the second pump and via a second secondary hydraulic circuit controlled by the first pump. This configuration for the hydraulic system may result in cross-talk of fluid flows that reduces precision of the actuators.

The controller may determine that one or more criteria for re-allocating flow through multiple hydraulic circuits are satisfied. For example, the criteria may be whether an operator assistance mode is enabled and/or whether a position of a work implement satisfies a condition, as described above. Based on determining that the criteria are satisfied, the controller may cause closing (e.g., fully or partially) of valves that control the secondary hydraulic circuits. Closing of the valves may isolate the first actuator from the second pump (e.g., so that the second pump does not provide control of the first actuator via the second secondary hydraulic circuit) and may isolate the second actuator from the first pump (e.g., so that the first pump does not provide control of the second actuator via the first secondary hydraulic circuit). In this way, the first actuator and the second actuator can be controlled with greater precision, which is useful for operations that require a high degree of precision (e.g., grading operations of an excavator performed when a user assistance mode is activated).

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A hydraulic system, comprising:

a first actuator to control a first linkage member;

a second actuator to control a second linkage member connected to the first linkage member and to a work implement of a machine;

a first primary hydraulic circuit and a first secondary hydraulic circuit that include the first actuator;

a second primary hydraulic circuit and a second secondary hydraulic circuit that include the second actuator;

a first pump to cause fluid to flow through the first primary hydraulic circuit and the second secondary hydraulic circuit;

a second pump to cause fluid to flow through the second primary hydraulic circuit and the first secondary hydraulic circuit; and a controller configured to:

determine that an operator assistance mode is enabled for the machine; and cause, based on determining that the operator assistance mode is enabled, closing of a first valve that controls fluid flow through the first secondary hydraulic circuit and a second valve that controls fluid flow through the second secondary hydraulic circuit, wherein the controller is configured to cause partial closing of the first valve and the second valve.

2. The hydraulic system of claim 1, wherein the work implement is a bucket, the first linkage member is a boom member, and the second linkage member is a stick member.

3. The hydraulic system of claim 1, wherein the controller is configured to cause full closing of the first valve and the second valve.

4. The hydraulic system of claim 1, wherein the controller is configured to cause closing of the first valve and the second valve to isolate the first actuator from the second pump and isolate the second actuator from the first pump.

5. The hydraulic system of claim 1, wherein the controller is further configured to:

detect that a position of the work implement is a threshold distance from a grade line, wherein the controller is configured to cause closing of the first valve and the second valve further based on detecting that the position of the work implement is the threshold distance from the grade line.

6. The hydraulic system of claim 1, wherein the controller, to cause closing of the first valve and the second valve, is configured to:

determine a first fluid flow setting for the first valve and a second fluid flow setting for the second valve; and cause closing of the first valve according to the first fluid flow setting and closing of the second valve according to the second fluid flow setting.

7. A method, comprising:

determining that an operator assistance mode is enabled for a machine having a work implement, wherein a first linkage member of the machine is controlled by a first actuator, and a second linkage member of the machine, connected to the first linkage member and to the work implement, is controlled by a second actuator, and wherein a first primary hydraulic circuit and a first secondary hydraulic circuit include the first actuator, and a second primary hydraulic circuit and a second secondary hydraulic circuit include the second actuator;

detecting that a position of the work implement satisfies a condition relating to the operator assistance mode; and causing, based on determining that the operator assistance mode is enabled and detecting that the position of the work implement satisfies the condition, closing of a first valve that controls fluid flow through the first secondary hydraulic circuit and a second valve that controls fluid flow through the second secondary hydraulic circuit, wherein the condition is that the position of the work implement is a threshold distance from a grade line.

8. The method of claim 7, wherein the operator assistance mode is for a grading operation, a leveling operation, or a digging operation.

9. The method of claim 7, wherein the operator assistance mode automates movement of one or more of the first linkage member, the second linkage member, or the work implement.

10. The method of claim 7, wherein a first pump is configured to cause fluid to flow through the first primary hydraulic circuit and the second secondary hydraulic circuit, and a second pump is configured to cause fluid to flow through the second primary hydraulic circuit and the first secondary hydraulic circuit.

11. The method of claim 10, wherein causing closing of the first valve and the second valve isolates the first actuator from the second pump and isolates the second actuator from the first pump.

12. The method of claim 7, further comprising:

detecting that the position of the work implement satisfies a different condition; and causing, based on detecting that the position of the work implement satisfies the different condition, opening of the first valve and the second valve.

13. An excavator, comprising:

a bucket;

a stick member connected to the bucket;

a boom member connected to the stick member;

a stick actuator to control the stick member;

a boom actuator to control the boom member;

a primary stick hydraulic circuit and a secondary stick hydraulic circuit that include the stick actuator;

a primary boom hydraulic circuit and a secondary boom hydraulic circuit that include the boom actuator;

a first pump to cause fluid to flow through the primary boom hydraulic circuit and the secondary stick hydraulic circuit;

a second pump to cause fluid to flow through the primary stick hydraulic circuit and the secondary boom hydraulic circuit; and a controller configured to:

detect that a position of the bucket satisfies a condition; and cause, based on detecting that the position of the bucket satisfies the condition, closing of a first valve that controls fluid flow through the secondary boom hydraulic circuit and a second valve that controls fluid flow through the secondary stick hydraulic circuit.

14. The excavator of claim 13, wherein the controller, to cause closing of the first valve and the second valve, is configured to:

determine a first fluid flow setting for the first valve and a second fluid flow setting for the second valve; and cause closing of the first valve according to the first fluid flow setting and closing of the second valve according to the second fluid flow setting.

15. The excavator of claim 13, wherein the condition is that the position of the bucket is a threshold distance from a grade line.

16. The excavator of claim 15, wherein the grade line is according to an operator setting for the excavator or an operating plan for the excavator.

17. The excavator of claim 15, wherein the threshold distance from the grade line is further from the grade line than a different threshold distance from the grade line used for activating an operator assistance mode for the excavator.

18. The excavator of claim 13, wherein the controller is configured to detect the position of the bucket using one or more sensors associated with one or more of the bucket, the stick member, or the boom member.

* * * * *